US007976341B2

(12) United States Patent
Osenberg

(10) Patent No.: US 7,976,341 B2
(45) Date of Patent: Jul. 12, 2011

(54) SHIELDED CONNECTOR AND METHOD FOR PRODUCING THE SAME

(75) Inventor: Holger Osenberg, Radevormwald (DE)

(73) Assignee: Escha Bauelemente GmbH, Halver (DE)

( * ) Notice: Subject to any disclaimer, the term of this patent is extended or adjusted under 35 U.S.C. 154(b) by 0 days.

(21) Appl. No.: 12/293,127

(22) PCT Filed: Mar. 16, 2007

(86) PCT No.: PCT/EP2007/002353

§ 371 (c)(1),
(2), (4) Date: Sep. 16, 2008

(87) PCT Pub. No.: WO2008/061572

PCT Pub. Date: May 29, 2008

(65) Prior Publication Data

US 2009/0068891 A1 Mar. 12, 2009

(30) Foreign Application Priority Data

Mar. 16, 2006 (DE) ..... 10 2006 012 194

(51) Int. Cl.
*H01R 9/03* (2006.01)

(52) U.S. Cl. ..... 439/607.41

(58) Field of Classification Search ..... 439/607.41, 439/354, 357–358, 350, 660, 353
See application file for complete search history.

(56) References Cited

U.S. PATENT DOCUMENTS

| | | | | |
|---|---|---|---|---|
| 3,643,007 | A * | 2/1972 | Roberts et al. | 174/106 R |
| 4,272,148 | A | 6/1981 | Knack, Jr. | |
| 4,310,213 | A * | 1/1982 | Fetterolf et al. | 439/320 |
| 4,386,819 | A | 6/1983 | Asick et al. | |
| 4,433,206 | A * | 2/1984 | Lewis | 174/359 |
| 4,611,878 | A | 9/1986 | Hall et al. | |
| 4,896,000 | A * | 1/1990 | Procter et al. | 174/74 R |
| 5,052,947 | A | 10/1991 | Brodie et al. | |
| 5,108,311 | A * | 4/1992 | Nakazawa | 439/607.32 |
| 5,645,450 | A * | 7/1997 | Yamada et al. | 439/585 |
| 6,231,392 | B1 * | 5/2001 | van Woensel | 439/607.44 |
| 6,364,684 | B1 * | 4/2002 | Kameyama | 439/354 |

FOREIGN PATENT DOCUMENTS

| | | | |
|---|---|---|---|
| DE | 102004029300 | A1 | 1/2005 |
| EP | 0040941 | A1 | 12/1981 |
| EP | 1471610 | A | 10/2004 |
| GB | 2337878 | A | 12/1999 |

OTHER PUBLICATIONS

International Search Report for PCT/EP2007/002353, dated Jun. 12, 2007.

English Translation of the International Preliminary Report on Patentability (IPER), International Application No. PCT/EP2007/002353, dated Dec. 18, 2008.

* cited by examiner

*Primary Examiner* — Jean F Duverne

(74) *Attorney, Agent, or Firm* — Kevin P. Radigan, Esq.; Heslin Rothenberg Farley & Mesiti P.C.

(57) ABSTRACT

The invention relates to a screened connector comprising a cable, which has at least one conductor and a screen braid, a contact support, which is provided with at least one contact element which holds a stripped end of the at least one conductor of the cable, and screening for the at least one conductor, the screening having a fastening region to which the screen braid of the cable is fastened, the screen braid being fastened to the outside of the screening.

32 Claims, 7 Drawing Sheets

SHIELDED CONNECTOR AND METHOD FOR PRODUCING THE SAME

CROSS REFERENCE TO RELATED APPLICATIONS

This application is a national stage filing under section 371 of International Application No. PCT/EP2007/002353, filed on Mar. 16, 2007, and published in German on May 29, 2008, as WO 2008/061572 A2, and which claims priority of German application No. 10 2006 012 194.5, filed on Mar. 16, 2006, the entire disclosure of these applications being hereby incorporated herein by reference.

TECHNICAL FIELD

The invention relates to a screened or shielded connector.

BACKGROUND OF THE INVENTION

Screened connectors are used mainly in electronics, automation technology and telecommunications for passive or active components in order to connect a screened cable to a component holding the connector.

Known screened connectors have a plug insert which is provided with at least one or more contact elements to which the wire(s) of the cable to be connected to the connector is (are) connected. The cable has at least one wire and a screen braid. Screening to which the screen braid is fastened is provided between the plug insert and the cable.

For assembly, the screen braid of the cable is exposed, the screening is pushed onto the cable, the wires are stripped of insulation and connected to the contact elements and the screen braid is fastened to the screening. The connector is then insert-moulded.

Since the screening is arranged on the cable, there is the disadvantage that different screenings are required for different cable thicknesses, which means higher production costs.

SUMMARY OF THE INVENTION

It is therefore the object of the invention to provide a screened connector according to the precharacterizing clause of claim 1, in which the screening can be used for different cable diameters.

The object of the invention is achieved by a screened connector according to the features of claim 1, and advantageous developments of the invention are stated in the dependent claims.

According to the invention, a screened connector according to one embodiment of the invention comprises a cable which has at least one conductor and a screen braid, a contact support which is provided with at least one contact element which receives a stripped end of the at least one conductor of the cable, and screening for the at least one conductor, the screening having a fastening region to which the screen braid of the cable is fastened, the screen braid being fastened to the outside of the screening.

The designation screen braid is not to be understood in the narrow sense. The term screen braid is intended to include a cable screening comprising a resilient material. This includes, in particular, the customary screenings comprising braided metal wires. Alternatively, the screen braid could be formed from a resilient conductive material, such as, for example, an electrically conductive plastic. Other cable screenings known to the person skilled in the art are likewise conceivable.

The invention has the advantage that the cable is not inserted into the screening. The same screening can therefore be used for different cables having different external diameters. In particular, the internal diameter of the screening may be smaller than the external diameter of the cable. As a result, it is possible, for example, to manage without tools for screen housings of different sizes. Moreover, manufacture can be effected with greater tolerances since the internal diameter of the screening is independent of the external diameter of the cable.

If, according to the preferred embodiment of the invention, the screen braid is fastened to the screening by means of a crimp sleeve, there is the advantage that the crimping can be effected against a hard counter-stop. This is advantageous compared with the prior art in which the cable might be damaged if the crimping of the crimp sleeve for fastening the screen braid is effected on the relatively soft sheath of the cable. If it is wished to avoid this, a hard underlay ring will have to be arranged under the screen braid for crimping, which gives rise to an additional manufacturing effort and hence higher costs. Advantageously, the screening has a hard housing on which the screen braid and the crimp sleeve can be arranged so that a hard counter-stop is provided for the crimping process. The same advantages of a hard counter-stop also arise in the case of alternative fastening methods, such as, for example, soldering, welding or adhesive bonding.

According to this embodiment of the invention, there is also the advantage that the screening must no longer be pushed onto the cable for assembly but can be applied after the connection of the at least one conductor to the at least one contact element. The screening may therefore have an opening having a diameter which is smaller than the external diameter of the cable but is sufficient for receiving the at least one conductor. This has the advantage of independence of the cable sheath diameter because the cable sheath can be arranged outside the screening and only the screen braid must be placed on the fastening region of the screening and fastened there in a suitable manner. Because of this arrangement, a virtually smooth or stepless transition from the cable to the connector can also be achieved if the screening is insert-moulded with the screen braid.

According to the invention, the screened connector can preferably have a plurality of contact elements in a contact support, the number of contact elements preferably corresponding to the number of conductors of the cable, for example 3, 4, etc. Wires or conductors from which the insulation has been stripped can, for example, be soldered, welded, laser-bonded or crimped onto the corresponding contact elements.

According to an embodiment of the invention, in the case of the screened connector, the screening may additionally or alternatively have, at least in the fastening region for the screen braid, a plurality of parts which run side by side in a longitudinal direction of the cable and can be connected to one another to form a screening enclosing the at least one conductor, preferably two of said parts.

According to an embodiment of the invention, in the case of the screened connector, the screening may additionally or alternatively have, at least in the fastening region for the screen braid, a screen housing which is formed from a plurality of parts, preferably two parts.

For example, the parts may be connected to one another via a hinge connection (e.g. film hinge, etc). The assembly can be simplified thereby.

The screen housing may be formed, for example, from die-cast zinc, die-cast aluminium, sheet metal (press-bent part, deep-drawn part), brass, steel, copper, aluminium or a conductive plastic.

According to an embodiment of the invention, in the case of the screened connector, the screening may additionally or alternatively have a longitudinal slot at least in the fastening region for the screen braid. This gives rise to the advantage that the screening can be expanded for arrangement on the screened connector. For example, the screening can be elastically formed for this purpose or can be provided with a joint (e.g. film hinge, hinge, etc).

According to the invention, the screening may extend from the plug element to the screen braid of a cable attached to the connector.

According to the invention, the screening may be formed from brass, steel, die-cast metal, conductive plastic, copper alloy or a combination of a plurality of materials.

According to the invention, the screening may comprise a screen sleeve which surrounds the contact element and is adjacent to the plug insert. The screen sleeve can be joined, screwed, pressed, adhesively bonded or welded by means of a suitable device to the plug insert or the contact support holding the contact element or the contact elements.

In embodiments of the invention without a screen sleeve, for example, a cap screw, a lock nut or another connecting element can finally be mounted from the plug side. A tapered entry and clearances for a locking effect could be provided on the screening (or the screen housing halves).

According to the invention, the screening may have two shells which together form a screen housing, one end of which encloses the screen sleeve and the other end of which forms the fastening region. The screen sleeve may comprise, for example, a groove which is engaged by corresponding folds on the shells of the screen housing. Stops may also be provided on the shells in order to achieve good orientation of the screen sleeve relative to the screen housing.

According to the invention, the two shells can be connected to one another by means of a press fit. For example, the two shells can be provided with pegs and holes by means of which a press fit is created on joining. Alternatively or additionally, the shells can be welded, adhesively bonded, soldered, riveted or screwed.

Alternatively or additionally, the two shells may be connected to one another, for example on one side, by means of a hinge connection. This may simplify assembly.

According to an embodiment of the invention, in the case of the screened connector, at least one opening for the injection of casting material may additionally or alternatively be provided in the screening.

Preferably, a plurality of openings can be provided. For example, in the case of screening comprising two housing halves, an opening can be provided in each case in each housing half. For example, at least one opening can also alternatively or additionally be provided on a connecting line of the two housing halves.

According to an embodiment of the invention, in the case of the screened connector, the screening may additionally or alternatively form an interior which is preferably completely filled with a casting material.

Casting material seals the interior from the connector and the cable. Thus, the connector is firstly protected from moisture (or other fluids) creeping through the cable or dirt particles (dust, etc) or other foreign bodies. A higher IP protection class is achieved thereby. Secondly, it is very probably ensured that no moisture can penetrate through the connector into the cable, which could otherwise lead to problems at the other end of the cable.

Additionally or alternatively, the screening, the screen braid and the cable may be at least partly and preferably completely enclosed by a casting material.

The interior of the screening can be filled with the same casting material which at least partly and preferably completely encloses the screening, the screen braid and the cable from the outside.

The casting material can preferably be a hotmelt adhesive. The use of a hotmelt adhesive has the advantage that a fluid-tight, i.e. gas-tight and liquid-tight, connection from the cable sheath opening to the plug insert is provided. At the same time, the hotmelt adhesive provides a secure and reliable connection of the two housing halves of the screening to the screen sleeve or the plug insert. As an alternative to a hotmelt adhesive, potting material comprising of one or more components (preferably two) or insert moulding material can also be used.

According to the invention, a crimp sleeve can be provided for fastening the screen braid to the fastening region of the screening. Alternatively or additionally, the screen braid can also be fastened to the screening by other techniques known to the person skilled in the art, for example welding, riveting, lashing, etc.

The crimp sleeve may be formed, for example, from brass, iron or another non-noble metal. In the crimping, for example, a square crimp, a hexagonal crimp or another polygonal crimp can be formed. Alternatively or additionally, the screen braid can be soldered, welded or adhesively bonded to the fastening section of the screening. According to the invention, the crimp sleeve may also be slotted and may rest in a springy manner on the screen braid and may be clamped against the screening.

According to the invention, a connecting element for connecting the screened connector to a counterpart can be provided. The connecting element may be, for example, a cap screw, a lock nut, a snap connecting element, a coupling part, a plug connector or a locking part. The counterpart may be, for example, a mating plug or a slot in a housing.

According to the invention, the screening may have an angle section.

The angled formation of the screening results, for example, in an angle connector.

According to the invention, the screening may also be substantially straight. The straight formation of the screening results, for example, in a coaxial connector.

According to the invention, it is also possible to provide a covering comprising injection-moulded material, for example comprising thermoplastics, cross linking elastomers, rubber or LSR.

The object of the invention is also achieved by a connecting cable having one or more and preferably two screened connectors according to the invention which preferably have a common cable.

The object of the invention is also achieved by methods for producing a screened connector, comprising the following steps:

a) arrangement of a connecting element on a cable which has at least one conductor and a screen braid,
b) fastening of the at least one conductor or of the conductors of the cable to one or more contact elements of a contact support, and
c) arrangement of a screening on the contact support and around the conductors, d) the screen braid being fastened on a fastening region of the screening on the outside of the screening.

The advantages mentioned result because, according to one point of view, the screening may have an internal diameter which is smaller than the external diameter of the cable sheath. There is therefore no dependence on the cable sheath diameter.

According to the invention, step c) may comprise the joining of at least two parts of a screening. Alternatively or additionally, step c) may comprise the expansion of a slotted screening.

Preferably, the screen braid can be fastened in step d) by means of a fastening sleeve, preferably a crimp sleeve, on the screening, the fastening sleeve or crimp sleeve preferably being arranged in step a) before the connecting element on the cable.

According to the invention, the interior of the screening can preferably be completely filled with a casting material, preferably a hotmelt adhesive. The screening, the screen braid and the cable can preferably be at least partly enclosed by the casting material, the desheathed screen braid preferably being completely enclosed by the casting material.

The fastening of the conductors to the contact elements can be effected, for example, by soldering, welding, laser-bonding or crimping.

According to the invention, a housing can be applied to the screened connector by insert moulding.

According to the invention, the connecting element may be a cap screw, a lock nut, a snap connector, a coupling part, a plug connector or a locking part.

The object of the invention is also achieved by a method for producing a screened connector, comprising the following steps:

a) arrangement of a fastening sleeve and of a connecting element on a cable,
b) fastening of the conductors of the cable to contact elements of a plug insert, and
c) arrangement of a screening on the plug insert and around the conductors.

According to the invention, step c) may comprise the joining of at least two parts of a screening.

Alternatively or additionally, according to the invention, step c) may comprise the expansion of slotted screening.

BRIEF DESCRIPTION OF THE DRAWINGS

The invention is described in more detail below with a reference to the embodiments shown in the figures.

Figure 1:
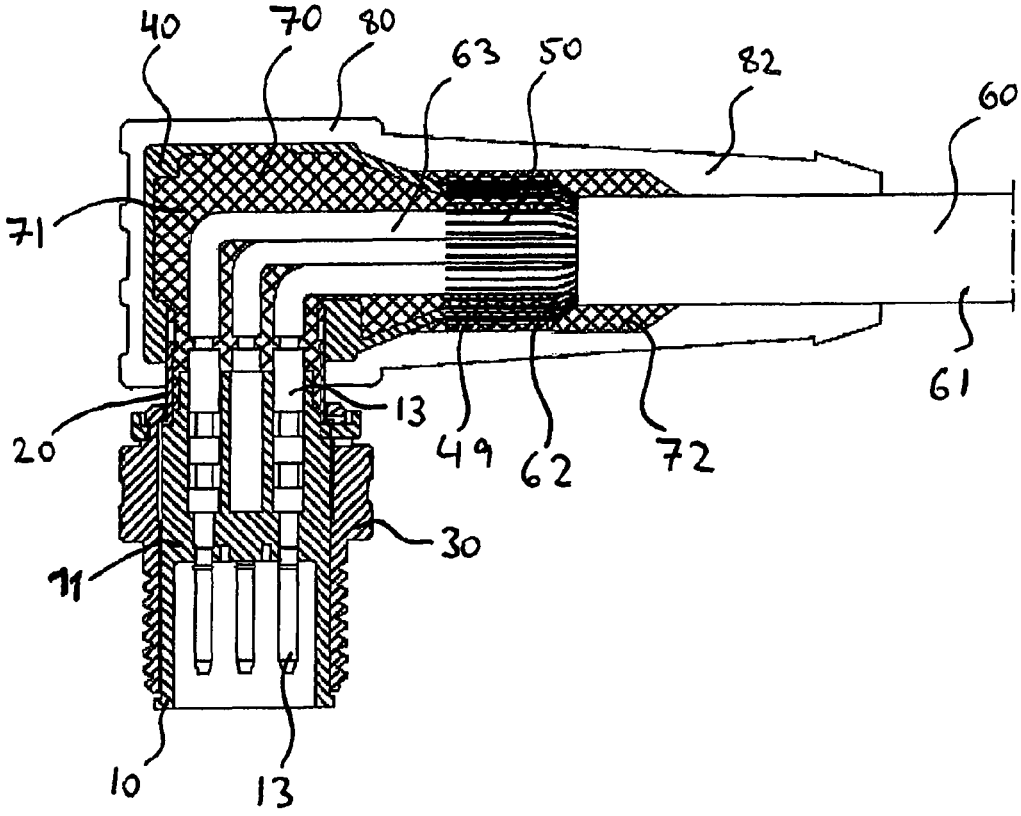
FIG. 1 shows a sectional view of a first embodiment of the invention.
Figure 2:
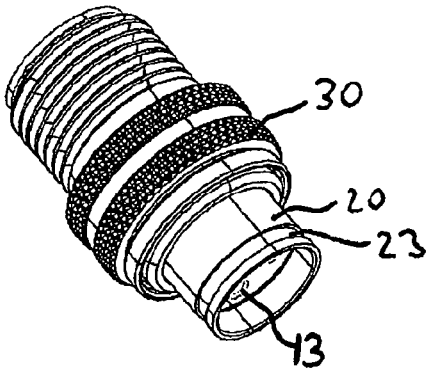
FIG. 2 shows a perspective view of a plug insert having a cap screw and screen sleeve.

The following reference numerals are used in the description of the embodiments:

10 Plug insert
11 Contact support
13 Contact element
24 Antirotation recess
20 Screen sleeve
21 Cylinder wall
22 Flange
23 Groove
24 Recess for antirotation device
25 Projection (tongue of a tongue-and-groove joint) as an antirotation stop
30 Connecting element (e.g. cap screw)
40 Screening
41A, 41B Screen housing halves
42A, 42B Opening (for injection of hotmelt adhesive))
43, 44, 45 Pegs
46 Stop
47 Beading
471 Projection (tongue of tongue-and-groove joint) as an antirotation stop
48A, 48B Cut-out
49 Fastening region
50 Crimp sleeve
60 Cable
61 Sleeve
62 Screen braid
63 Conductor
70 Adhesive bond
71 Inner region
72 Outer region
80 Insert moulding
81 Contoured region
82 Conical region

DETAILED DESCRIPTION OF THE INVENTION

FIGS. 1 to 10 show a first embodiment of the invention, i.e. an angle connector, while FIGS. 4A, 5A, 6A and 8A show details of a second embodiment of the invention. The first embodiment is described below. Thereafter, with regard to the second embodiment, only the differences are described and otherwise reference is made to the description of the first embodiment, identical reference numerals designating identical components. Corresponding components have the same reference numerals but with a prime.

Figure 3:
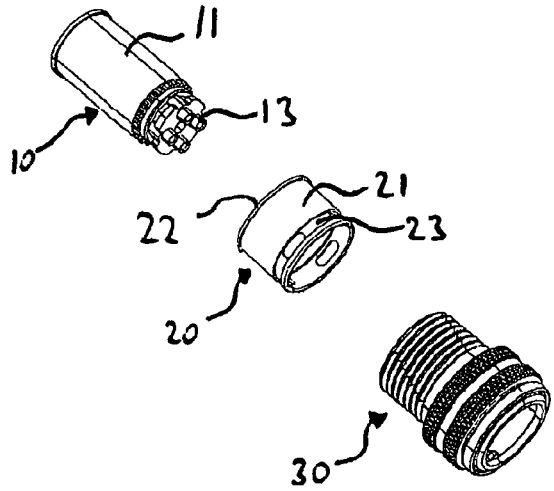
FIG. 3 shows an exploded drawing of the parts of FIG. 2.
Figure 4:
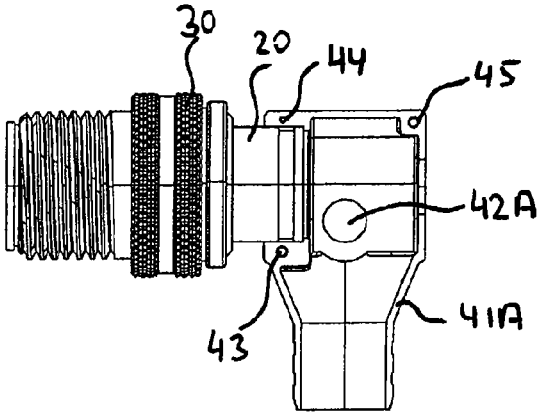
FIG. 4 shows a view of the parts of FIG. 2 with a screen housing half according to the first embodiment of the invention.
Figure 5:
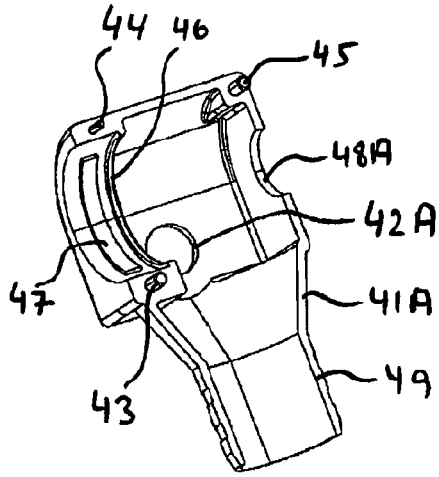
FIG. 5 shows a perspective view of the screen housing half of FIG. 4.

FIG. 1 shows a sectional diagram of the first embodiment of the invention. A plug insert 10 has a contact support 11 with four contact elements 13. A screen sleeve 20, which is shown in more detail in FIG. 3, is adjacent to the contact support element. The screen sleeve 20 has a cylindrical wall 21 and flange 22, with which the screen sleeve 20 is held on the plug insert 10 by means of a cap screw 30. Furthermore, the screen sleeve has a groove 23 which is engaged by screen housing halves 41A, 41B of the screening 40 with corresponding beadings 47 (cf. FIG. 5). In order to ensure the correct orientation of the screen housing halves, stops 46 (cf. FIG. 5) are provided.

The screen housing halves 41A, 41B each have an opening 42A and 42B, respectively, for injection of hotmelt adhesive. The screen housing half 41A has pegs 43, 44 and 45 (cf. FIGS. 4 and 5) which engage corresponding holes (not shown) in the housing half 41B. The dimensions are such that a press fit is achieved on assembly of the screen housing halves. The press fit has the advantage that the further assembly is simplified because the housing halves are fixed to one another, which substantially simplifies the insertion into the mould for the arrangement of the potting compound.

Figure 6:
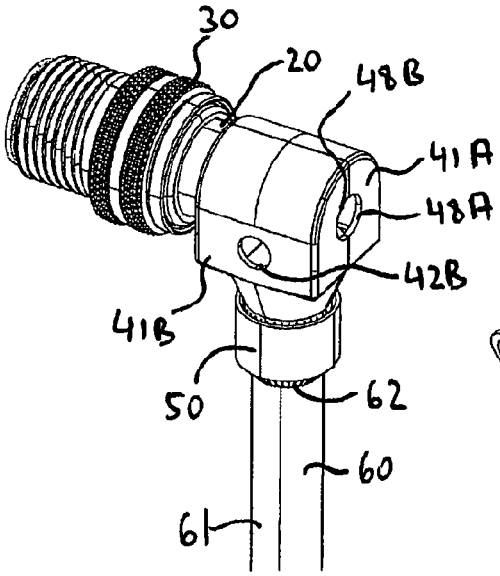
FIG. 6 shows a perspective view of the parts of FIG. 2 with two screen housing halves, a cable and a crimp sleeve according to the first embodiment of the invention.
Figure 7:
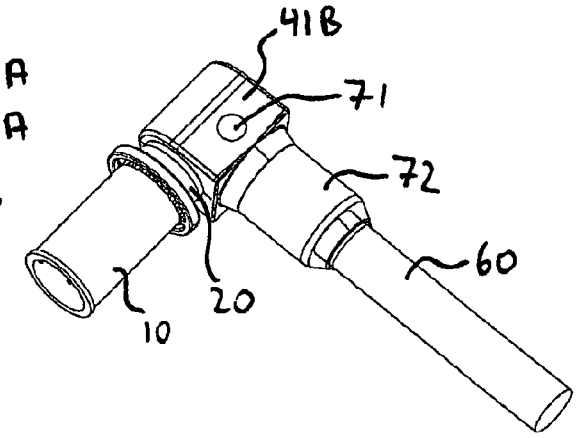
FIG. 7 shows a perspective view of the parts of FIG. 2 without cap screw and with two screen housing halves, a cable, a crimp sleeve and prepotting in the screening and around the crimp sleeve and the cable according to the first embodiment of the invention.
Figure 4A:
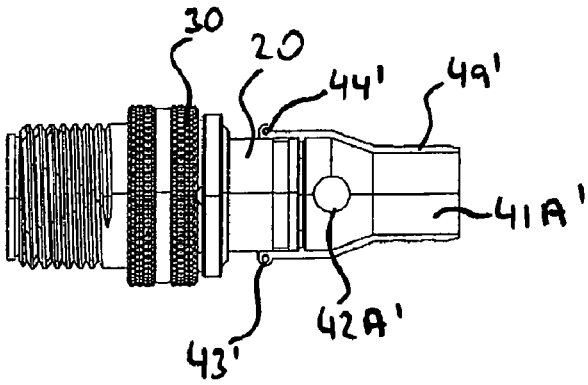
FIG. 4A shows a view of the second embodiment of the invention, corresponding to FIG. 4.
Figure 5A:
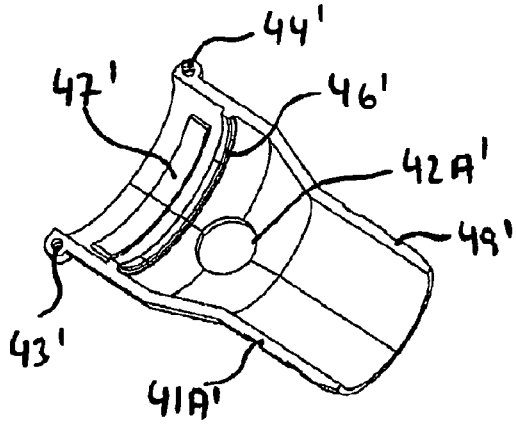
FIG. 5A shows a view of a second embodiment of the invention, corresponding to FIG. 5.
Figure 6A:
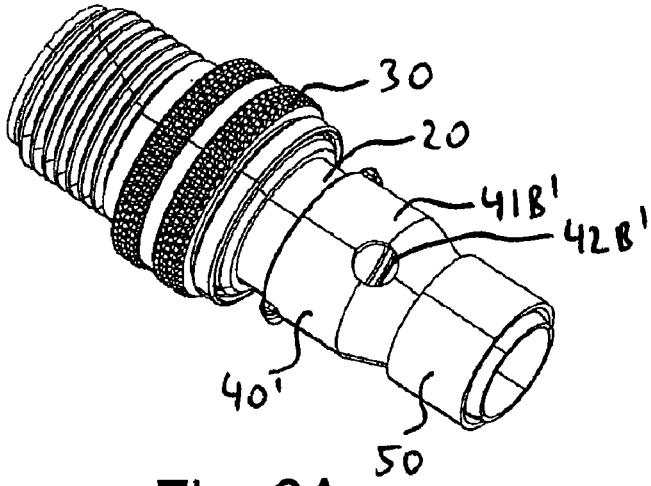
FIG. 6A shows a view of a second embodiment of the invention, corresponding to FIG. 6.

The screen housing halves 41A, 41B have, on their respective back, cut-outs 48A and 48B, respectively, which together form a further opening on assembly (cf. FIG. 6). Furthermore, the screen housing halves 41A, 41B have a fastening region 49 on which a screen braid 62 of a cable 60 is fastened by means of a crimp sleeve 50.

The cable 60 has a sheath surface 61 which is removed in the region of the fastening of the screen braid 62. The cable 60 comprises four conductors 63 whose stripped wires are fastened to the respective contact elements 13.

A hotmelt adhesive 70 which extends into the cable 60 and to the plug insert is introduced in the interior of the screen housing 41A, 41B of the screening. By completely filling the inner region 71, very good tightness against fluids (gases and liquid) is achieved. The hotmelt adhesive is also provided in the outer region 72 (cf. FIG. 7).

In tests carried out by the applicant, it was found that the design according to the invention makes it possible to ensure that the screened connector, the interior of which is completely filled with hotmelt adhesive, withstands a superatmospheric pressure of at least 0.5 bar (corresponds to 1.5 bar pressure) applied at the open cable end. Owing to this high compressive strength, the operational safety and reliability of these embodiments of the invention is considerably improved compared with the known screened connectors.

The total screening 40, including the hotmelt adhesive in the outer region 72, is insert-moulded with thermoplastic. The insert moulding 80 having the contours 81 and its conical region 82 can be best seen in FIGS. 8 to 10.

FIGS. 2 to 10 explain in a clear manner the individual steps for assembly of the first embodiment of the invention.

Figure 8A:
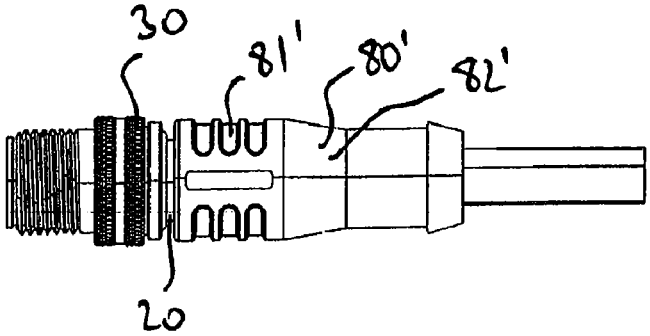
FIG. 8A shows a view of a second embodiment of the invention, corresponding to FIG. 8.
Figure 8:
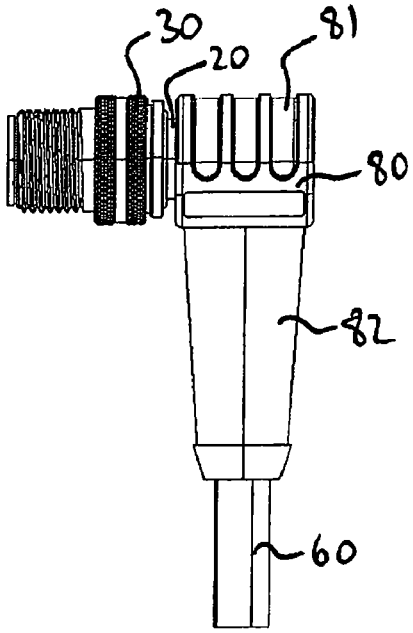
FIG. 8 shows a side view of the embodiment of FIG. 1.
Figure 9:
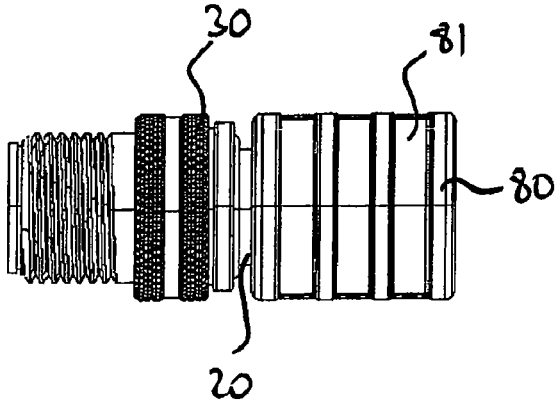
FIG. 9 shows a view of the embodiment of FIG. 1 from above.
Figure 10:
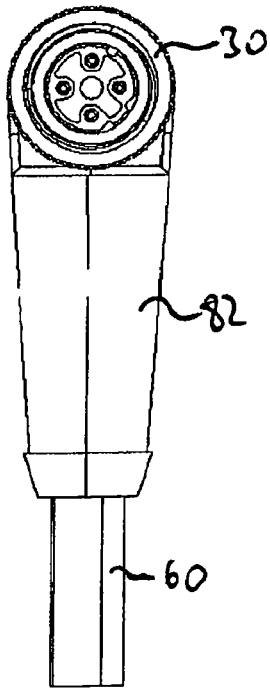
FIG. 10 shows a front view of the embodiment of FIG. 1.
Figure 11:
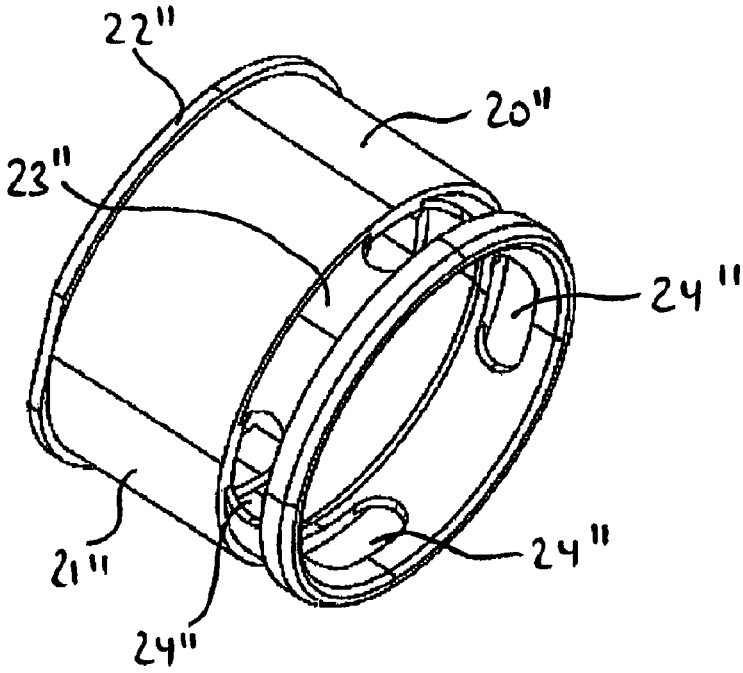
FIG. 11 shows a perspective view of a screen sleeve for a screened connector according to a further embodiment of the invention.
Figure 12:
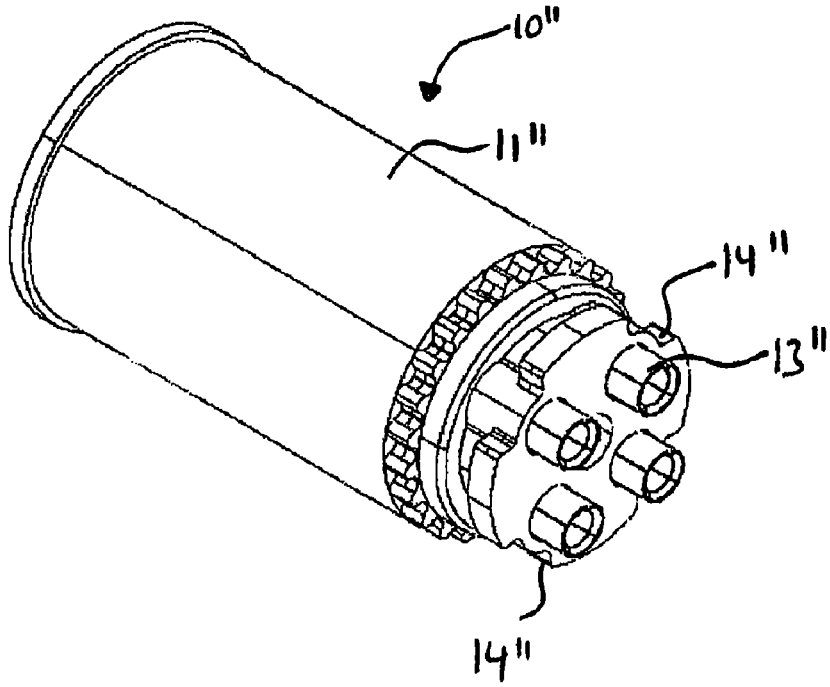
FIG. 12 shows a perspective view of a contact support for a screened connector according to the further embodiment of the invention.

- first, the crimp sleeve 50, the cap screw 30 (or alternative connecting means, as mentioned above) and the screen sleeve (if present) are drawn onto the assembled cable.
- the stripped wires of the conductors are fastened to the corresponding contact elements of the contact support.
- the screen sleeve is joined to the contact support by means of a known device.
- the cap screw (or alternative connecting elements) are then pushed onto the contact support. (An assembly substantially corresponding to FIG. 2 results thereby, but the cable is connected to the contact elements.)
- the screen housing halves are mounted on the screen sleeve and connected by means of a press fit (peg, hole). Alternative connections are conceivable, as mentioned above. The positionally accurate orientation of the contact support can and is ensured by an assembly device.
- the screen braid of the cable is pushed over the fastening region of the screening, and the crimp sleeve is arranged in the fastening region.
- the complete assembly is introduced into a crimping device and is crimped. In this stage of assembly, the assembly appears as in FIG. 6.
- the screen housing halves are adhesively bonded with hotmelt adhesive with the aid of a pre-moulding-in mould through an opening in the screen-housing halves. Both the complete inner region of the screen housing halves and the cable connection region in the region of the crimp sleeve and partly also the cable sheath are enclosed with hotmelt adhesive. This results in outstanding tightness. The assembly now appears as in FIG. 7, the screw cap not being shown there for the sake of clarity.
- the screened connector is finally insert-moulded with thermoplastic using suitable moulds. FIGS. 8 to 10 show the finished product.

FIGS. 4A, 5A, 6A and 8A show a second embodiment of the invention, substantially corresponding to the first embodiment. The second embodiment differs substantially only through the non-angular but straight formation of the screen housing halves 41A', 41B', as shown in particular in FIG. 5A. Otherwise, reference is made to the description of the first embodiment.

FIGS. 11 to 15 show a modification of the above mentioned and described embodiments having an antirotation device. The reference numerals have double primes and designate the corresponding components. Below, only the differences are described and otherwise reference is made to the above embodiments.

According to this embodiment, an antirotation device is provided. For this purpose, a so-called tongue-and-groove joint is provided in each case firstly between the screen sleeve 20" and the contact support 11" and secondly between the screen sleeve 20" and at least one housing part 41A", preferably both housing parts 41A".

Figure 13:
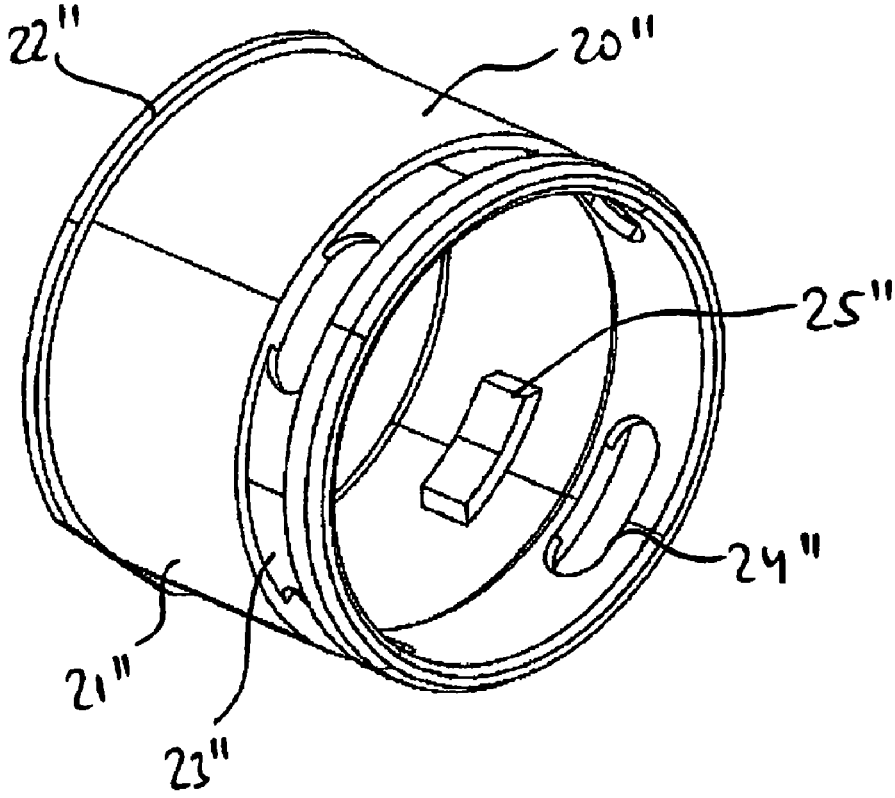
FIG. 13 shows a further perspective view of the screen sleeve of FIG. 11.
Figure 14:
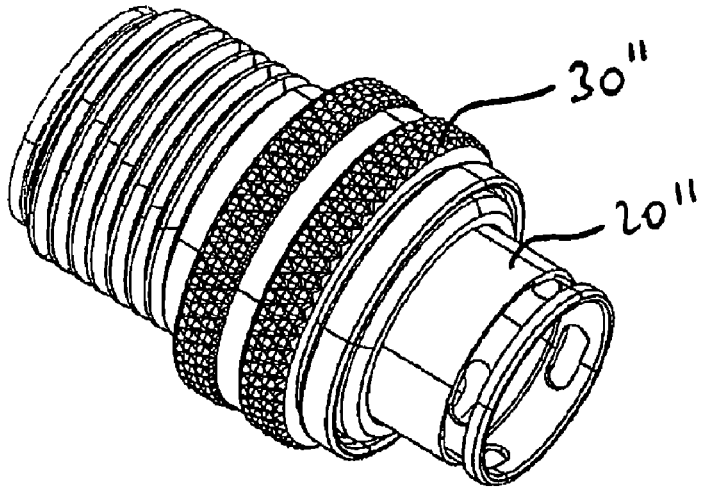
FIG. 14 shows a perspective view of the screen sleeve of FIG. 11 with a connecting element.
Figure 15:
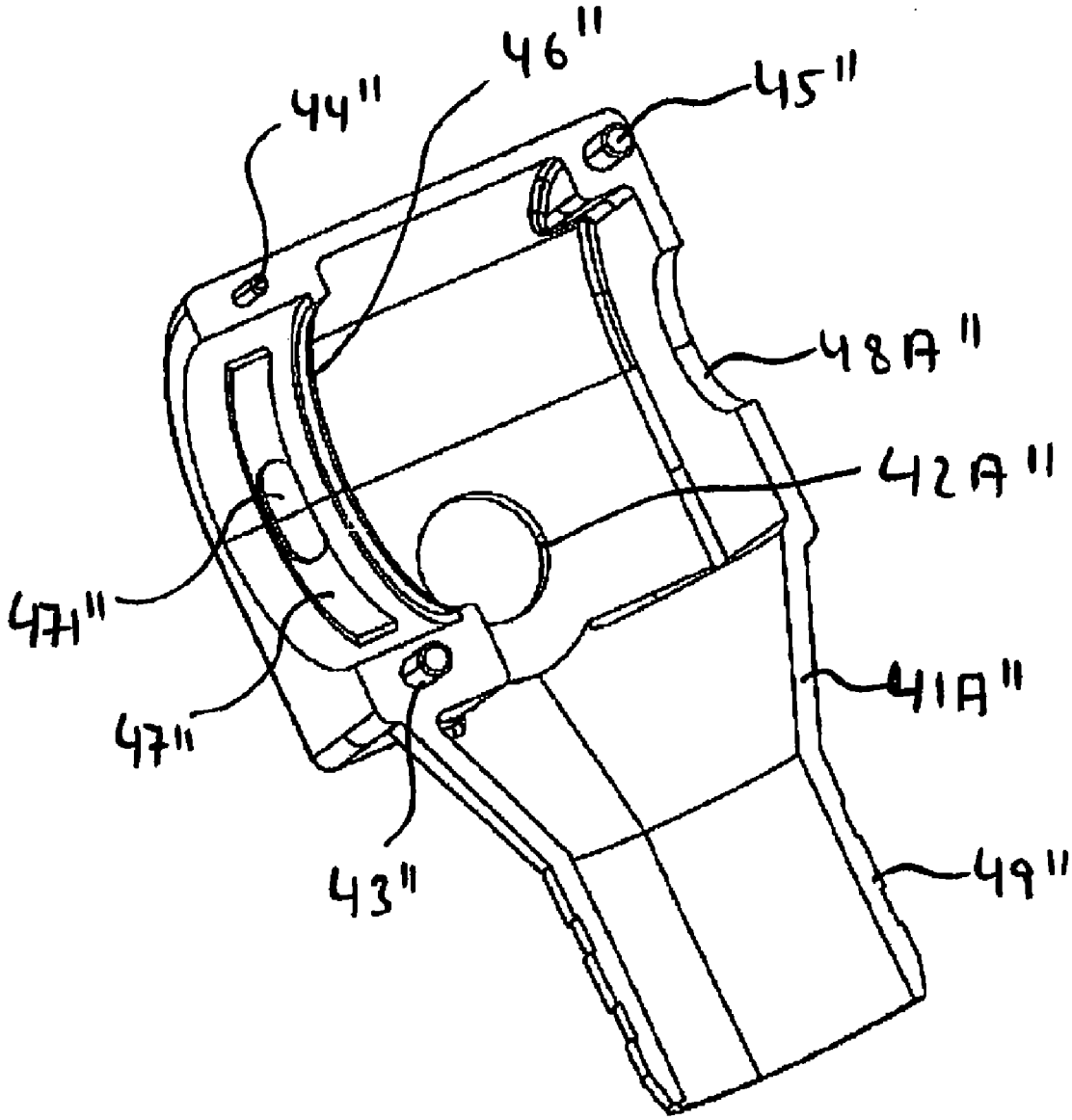
FIG. 15 shows a perspective view of the screen housing half for a screened connector according to the further embodiment of the invention.

As is evident from FIG. 13, projections 25" which cooperate with matching recesses 14" of the contact support 11" are provided on the inner wall of the screen sleeve 20".

A projection 471" (cf. FIG. 15) which cooperates with a matching recess 24" of the screen sleeve 20" (cf. FIG. 11 and FIG. 13) as an antirotation device in the assembled state is provided on the inner wall of the housing part 41A".

A corresponding projection can preferably be provided on the other housing part (not shown).

The antirotation device ensures that, on application of a force to the connector against the antirotation device, no rotation takes place which would cause detachment of the sealing casting material and hence impairment of the sealing effect.

In this context, no rotation means that at most a rotation is permitted which results in no detachment of the casting material. Thus, for example, a rotation of less than 3 degrees or preferably of less than 2 degrees and preferably of less than 1 degree could be permitted. The resilient casting material will exert a restoring force which brings the connector back to the rest position after elimination of the force. Preferably, no rotation should be possible. This embodiment is important in particular in the case of angled connectors in which slightly greater forces may be exerted.

The features of the antirotation device can of course advantageously be provided in all stated embodiments of the invention.

It is clear that alternatives obvious to the person skilled in the art on studying the documents and equivalent solutions should also be within the scope of protection of the present application.

The invention claimed is:

1. A shielded connector comprising a cable which has at least one conductor and a screen braid, a contact support which is provided with at least one contact element which holds a stripped end of the at least one conductor of the cable, screening for the at least one conductor, the screening having a fastening region to which the screen braid of the cable extends and to which the screen braid of the cable is fastened, an adhesive casting material affixing together and at least partly enclosing the cable, the screen braid, and the screening, wherein the screening forms an interior which is filled with a hotmelt casting adhesive, and wherein the adhesive casting material extends from the interior cavity, through the fastening region of the screening and the screen braid, to fill an area surrounding an outer portion of the fastening region of the screening, the area extending from the outer portion of the fastening region to an outer portion of the cable, and wherein the adhesive casting material adhesively bonds the outer portion of the cable, the screen braid, and the fastening region of the screening together.

2. The shielded connector of claim 1, wherein the screen braid is fastened to the outside of the screening.

3. The shielded connector according to claim 1, wherein the screening has, at least in the fastening region for the screen braid, a plurality of parts running side by side in the longitudinal direction of the cable which are connected to one another to form screening enclosing the at least one conductor.

4. The shielded connector according to claim 1, wherein the screening has, at least in the fastening region for the screen braid, a screen housing which is formed from a plurality of parts.

5. The shielded connector according to claim 1, wherein the screening has, at least in the fastening region for the screen braid, a screen housing which is formed from a plurality of housing parts.

6. The shielded connector according to claim 1, further comprising a crimp sleeve for fastening the screen braid provided on the fastening region of the screening.

7. The shielded connector according to claim 1, wherein the screen braid is soldered, welded, riveted, lashed and/or adhesively bonded to the fastening section of the screening.

8. The shielded connector according to claim 1, wherein a crimp sleeve has a slot and rests on the screen braid in a springy manner such that the screen braid is clamped against the screening.

9. The shielded connector according to claim 1, wherein the screening has a longitudinal slot at least in the fastening region for the screen braid.

10. The shielded connector according to claim 1, wherein the screening extends from the contact support to the screen braid of the cable.

11. The shielded connector according to claim 1, wherein the screening is formed from brass, steel, die-cast metal, conductive plastic, copper alloy or a combination of a plurality of materials.

12. The shielded connector according to claim 1, wherein the screening comprises a screen sleeve which surrounds the contact element and is adjacent to the contact support.

13. The shielded connector according to claim 1, wherein the screening has two shells which together form a screen housing, one end of which encloses the screen sleeve and the other end of which forms the fastening region for the screen braid.

14. The shielded connector according to claim 13, wherein the two shells are connected to one another by means of a press fit and/or a hinge connection.

15. The shielded connector according to claim 14, wherein the press fit has pegs engaging corresponding holes.

16. The shielded connector according to claim 1, wherein at least one opening is provided in the screening, for injecting the adhesive casting material.

17. The shielded connector according to claim 1, wherein the adhesive casting material comprises a hotmelt adhesive.

18. The shielded connector according to claim 1, wherein the desheathed screen braid is completely enclosed by a casting material.

19. The shielded connector according to claim 1, wherein a connecting element for connection of the screened connector is provided on a counterpart.

20. The shielded connector according to claim 1, wherein the screening has an angle section.

21. The shielded connector according to claim 1, wherein the screening is substantially straight.

22. The shielded connector according to claim 1, wherein an antirotation device which is preferably in the form of a tongue-and-groove joint is provided between the contact support and the screening.

23. The shielded connector according to claim 22, wherein the antirotation device limits the angle of rotation between the contact support and the screening to less than 5 degrees.

24. The shielded connector according to claim 1, wherein the screening has a screen sleeve, the inside of which is provided with at least one projection which engages at least one corresponding recess of the contact support as an antirotation device.

25. The shielded connector according to claim 1, wherein the screening has a screen sleeve and a housing, the screen sleeve having a groove which engages a part of the housing.

26. The shielded connector according to claim 1, wherein the screening has a screen sleeve and a housing, the screen sleeve having recesses provided in a groove which is engaged by a part of the housing, and at least one, corresponding projection which engages the recesses of the screen sleeve as an antirotation device provided on the housing.

27. The shielded connector according to claim 26, wherein the antirotation device limits the possible angle of rotation between the screen sleeve and the housing of the screening to less than 5 degrees.

28. The shielded connector according to claim 1, wherein the screening comprises continuous screening which encloses the at least one conductor along a length thereof from the fastening region for the screen braid to the contact support, between the fastening region for the screen braid and the contact support.

29. The shielded connector according to claim 1, wherein the contact support is part of a plug or coupling element.

30. The shielded connector according to claim 1, further comprising:

a plug insert, in which at least one contact element for receiving a conductor of a cable is provided, and screening for the at least one conductor, the screening having a fastening region to which a screen braid of the cable can be fastened; and wherein the screening is formed, at least in the fastening region for the screen braid, in such a way that the screening can be arranged, in at least the fastening region for the screen braid, for mounting around a conductor already fastened to a contact element of the plug insert.

31. The shielded connector according to claim 1, wherein the screening has, at least in the fastening region for the screen braid, a plurality of parts running side by side in the longitudinal direction of the cable, preferably two of said parts, which can be connected to one another to form a screening enclosing the at least one conductor.

32. The shielded connector according to claim 1, in combination with at least one additional screened connector to form a common cable.

* * * * *